US012049349B2

(12) United States Patent
Lee

(10) Patent No.: US 12,049,349 B2
(45) Date of Patent: Jul. 30, 2024

(54) CANISTER APPARATUS

(71) Applicant: Alchemy Jars LLC, Renton, WA (US)

(72) Inventor: Patrick Lee, Renton, WA (US)

(73) Assignee: Alchemy Jars LLC

( * ) Notice: Subject to any disclaimer, the term of this patent is extended or adjusted under 35 U.S.C. 154(b) by 42 days.

(21) Appl. No.: 17/820,345

(22) Filed: Aug. 17, 2022

(65) Prior Publication Data

US 2023/0057867 A1 Feb. 23, 2023

Related U.S. Application Data

(60) Provisional application No. 63/235,094, filed on Aug. 19, 2021.

(51) Int. Cl.
*B65D 77/04* (2006.01)
*B65D 43/02* (2006.01)

(52) U.S. Cl.
CPC ..... *B65D 77/0486* (2013.01); *B65D 43/022* (2013.01); *B65D 43/0231* (2013.01); *B65D 2543/00296* (2013.01); *B65D 2543/00509* (2013.01); *B65D 2543/00537* (2013.01); *B65D 2577/041* (2013.01)

(58) Field of Classification Search
CPC ..... B65D 77/0486; B65D 43/022; B65D 43/0231; B65D 2543/00296; B65D 2543/00509; B65D 2543/00537; B65D 2577/041; B65D 77/0493; A47G 23/0233; A47G 23/0241; A47G 2023/02; A47G 2023/0275; A47G 2023/0283; A47G 2023/0291
USPC ..... 220/241, 737, 739
See application file for complete search history.

(56) References Cited

U.S. PATENT DOCUMENTS

| | | | | | |
|---|---|---|---|---|---|
| 2,766,891 | A * | 10/1956 | Elzer | A23G 9/227 | 206/821 |
| 4,746,017 | A * | 5/1988 | Howard | B65D 77/0486 | 604/404 |
| 4,903,493 | A * | 2/1990 | Van Iperen | B65D 81/3862 | 206/524.4 |
| 5,355,684 | A * | 10/1994 | Guice | B65D 81/3841 | 62/457.2 |
| 5,437,387 | A * | 8/1995 | Burns | G21F 5/12 | 215/221 |
| 5,489,043 | A * | 2/1996 | Newman | A24F 1/30 | 220/636 |
| 8,251,221 | B1 | 8/2012 | Castaneda | | |
| 9,004,281 | B1 | 4/2015 | Castaneda | | |
| 2020/0359815 | A1* | 11/2020 | McDaniel | B65D 23/0885 | |
| 2022/0378235 | A1* | 12/2022 | Gu | A47G 23/0241 | |

* cited by examiner

*Primary Examiner* — Nathan J Jenness
*Assistant Examiner* — Eric C Baldrighi
(74) *Attorney, Agent, or Firm* — AEON Law, PLLC; Adam L. K. Philipp; James Namiki

(57) ABSTRACT

A canister apparatus configured to protect and seal a range of jars and perishable items therein from light, dehydration, loss of volatiles, and or rapid change in temperature. The canister apparatus comprising a canister lid, a canister base and a cup fit within the canister base. The canister lid may comprise a gasket and a boss that are sized to accommodate an airtight seal of a jar upon insertion substantially within the canister base. The cup is configured to secure a jar upon insertion substantially within the canister base. The canister apparatus may include a jar and a cover configured to couple to the jar.

20 Claims, 6 Drawing Sheets

CANISTER APPARATUS

CROSS-REFERENCE TO RELATED APPLICATIONS

This application claims priority to provisional U.S. Patent Application No. 63/235,094, filed Aug. 19, 2021, titled "Canister Apparatus," and naming Patrick Lee as the inventor. The entire contents of the above-referenced applications and all priority documents referenced in the Application Data Sheet filed herewith are hereby incorporated by reference for all purposes.

FIELD

The present disclosure relates to a canister apparatus, particularly a canister apparatus to accommodate a range of jars.

BACKGROUND

Some food, beverages, aromatic materials, smoked, vaporized, or aerosolized materials, materials comprising a volatile compound or element, and perishable items have limited shelf life and should not be exposed to open air for preservation (hereinafter, "perishable items"). Perishable items are sometimes provided to consumers in containers, such as jars or canisters, which sometimes comprise lids or not. Even if a container comprises a lid, the lid may not be suitable for storage of a perishable. For example, some lids may be well sealed at a factory, or the seal may be augmented by shrink-wrap plastic, but the seal may not function well after the container is opened and may allow the perishable to dehydrate or otherwise lose volatiles. For example, an original lid may leak contents if the container is inverted, or external liquids may enter the container through the lid in an undesired manner. For example, some containers may not prevent exposure to heat, and the condensation from water vapor of contents may arise due to the excess heat.

In addition, a jar may be fragile and vulnerable to external perturbation, such as from impact, which may break or damage the jar. For example, the jar may be made of glass or other fragile material. In addition, a consumer may wish to protect a jar or perishables in a jar from rapid temperature changes. Consumers may wish to protect a jar and perishables therein.

Needed is a multi-layer container, such as a canister to accommodate a range of jars, which can protect the range of jars from external perturbation, and which can hermetically seal the range of jars and protect perishables therein from dehydration, loss of volatiles, and rapid change in temperature and light.

BRIEF SUMMARY OF THE INVENTION

Embodiments described herein relate to apparatuses and methods to form an airtight seal for storing and preserving a volatile compound or element. Embodiments described herein provide solutions to preserve perishable items in an airtight sealed container free from harmful light and heat exposure.

According to some embodiments, a canister apparatus is described herein. The canister apparatus comprises a canister base, including a first internal cavity and a second internal cavity, wherein the first internal cavity comprises a first inner diameter and the second internal cavity comprises a second inner diameter, and wherein the first inner diameter is larger than the second inner diameter. The canister apparatus further comprises a canister lid including a gasket and a boss, wherein the gasket and the boss are sized to accommodate an airtight seal of a jar upon insertion substantially within the canister base. The canister apparatus further comprises a cup, wherein the cup fits within the first internal cavity. The cup comprises a cup interior wall including a third inner diameter, wherein the third inner diameter of the cup interior wall is smaller, equal to, or approximately the same as the second inner diameter of the second internal cavity. The cup is configured to deform and secure a jar upon insertion substantially within the canister base.

According to some embodiments, a canister apparatus is described herein. The canister apparatus comprises an enclosure including a first internal cavity and a second internal cavity, wherein the first internal cavity comprises a first inner diameter and the second internal cavity comprises a second inner diameter, and wherein the first inner diameter is larger than the second inner diameter. The canister apparatus further comprises a lid including one or more coupling components to secure the lid with the enclosure. The canister apparatus further comprises a cup, wherein the cup fits within the first internal cavity. The cup comprises a cup interior wall including a third inner diameter, wherein the third inner diameter of the cup interior wall is smaller, equal to, or approximately the same as the second inner diameter of the second internal cavity. The cup further comprises a plurality of ribs protruding inward, toward a center of the canister apparatus, from the cup interior wall.

According to some embodiments, the cup comprises an elastomeric material.

According to some embodiments, the canister apparatus further comprises a jar of a diameter and a depth to fit substantially within the canister base and mate with the cup.

According to some embodiments, the canister apparatus further comprises a cover coupled to an opening of the jar to provide an airtight seal between the cover and the jar.

According to some embodiments, the canister apparatus further comprises one or more gripping features coupled to the jar.

According to some embodiments, the gripping features include a first grip surface and a second grip surface opposed, wherein the first and second grip surfaces are configured to engage one or more fingers of a grasping hand.

According to some embodiments, the canister apparatus further comprises a spout coupled to the jar.

According to some embodiments, the canister apparatus further comprises a child-resistant closure coupled to the canister lid.

According to some embodiments, the canister apparatus further comprises an insulation layer between an exterior wall and an interior wall of the canister base.

The foregoing summary is illustrative only and is not intended to be in any way limiting. Features from any of the disclosed embodiments can be used in combination with one another, without limitation. In addition to the illustrative aspects, embodiments, and features described above, further aspects, embodiments, and features will become apparent by reference to the drawings and the following detailed description.

DETAILED DESCRIPTION OF THE INVENTION

Figure 1:
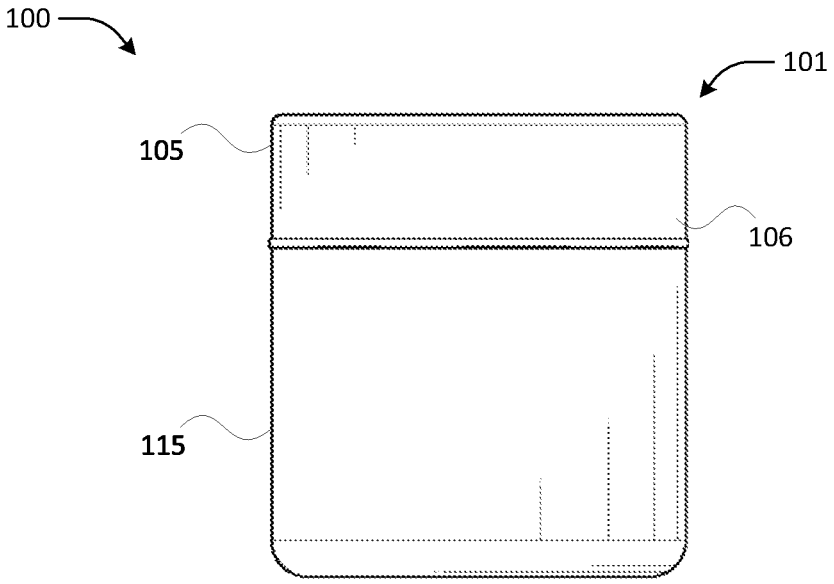
FIG. 1 is a side elevation view of a canister apparatus incorporated with teachings of the present disclosure, according to some embodiments.

In overview, this disclosure relates to a canister apparatus. Cannister apparatus may be used for storing and preserving perishable items.

The canister apparatus comprises a canister base, a first internal cavity within the canister base, a second internal cavity within the canister base, and a canister lid. The canister base may be formed of a rigid material, such as plastic, fiberglass, carbon fiber, or an aramid impregnated with resin, another composite, metal, or the like. The first internal cavity may have a larger diameter than the second internal cavity. The first internal cavity may be below the second internal cavity and closer to a bottom of the canister base. A shoulder may define a top boundary of the first internal cavity relative to the second internal cavity. A cup may fit within the first internal cavity. The cup may be made of an elastic material, such as an elastomer, silicone, rubber, urethane, or the like. The cup may be sized to fit between a bottom of the first internal cavity and the shoulder. The shoulder may prevent unwanted or accidental removal of the cup from the first internal cavity. The cup may have ribs protruding inward and toward a center of the canister apparatus on an interior wall of the cub. The cup may comprise a third inner diameter, which may be smaller in diameter than the inner diameter of the second internal cavity.

The canister lid and canister base may comprise coupling components to secure the canister lid and canister base together. The coupling components may comprise, for example, threads, a Quillfeldt stopper or "flip-top," or the like. The canister lid may be, for example, a child-resistant cap, press-and-twist cap, squeeze-and-twist cap, or the like. The canister lid may comprise an inner cap and an outer cap mounted over the inner cap, and the inner cap comprises threads to couple with the canister base.

The canister lid may comprise a boss or an emboss. The canister lid may accommodate a gasket. The gasket may be made of an elastic material, such as an elastomer, silicone, rubber, urethane, or the like. The boss or emboss may be sized to hold the gasket in a friction fitting so as to prevent or reduce unwanted removal of the gasket from the grove. The boss or emboss may allow the gasket to be compressed upon insertion of a jar substantially within the canister base.

A jar may be inserted into the canister apparatus. The jar may have an outer diameter that is smaller than the diameter of the first internal cavity. Because an outer perimeter of the cup abuts an inner perimeter of the first internal cavity within the canister base and because the canister base is formed of rigid material, one or more ribs of the cup may deform when the jar is inserted into the canister apparatus. The deformed ribs, the cup, the canister base, the canister lid, the gasket, and the boss may protect the jar from external perturbation and may hold the jar and canister base together. In some embodiments, the cup does not have ribs and the cup is of a size and material that is sufficient to contain the jar inside the canister apparatus. The cup may have a height less than one-half a height of an interior of the canister base, which reduces the use of materials and saves money.

The jar may be configured to hold perishable food or liquid. The material of the jar may be chosen from glass, metal, metal alloy, or plastic that best preserves the perishable food or liquid. For example, impermeable material such as glass may be chosen to preserve aromatic items. The jar may be of a size, volume, and shape that enables the jar to fit within the canister base.

The jar may comprise measurement indicators. The measurement indicators may be printed, bossed, or embossed on a surface of the jar. The jar may comprise a pouring sprout. The jar may further comprise a cover coupled with an opening of the jar. The cover provides an airtight seal between the cover and the jar. The jar may comprise gripping features, such as grooves on surfaces of the jar. The gripping features may be configured to engage one or more fingers of a grasping hand.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a side elevation view 100 of canister apparatus 101, according to some embodiments. Illustrated are canister lid 105 and canister base 115. Canister lid 105 may comprise canister lid exterior shell 106 and canister lid interior 107 (not shown in FIG. 1). Together, canister lid exterior shell 106 and canister lid interior 107 may be referred to as "canister lid 105". Canister lid exterior shell 106 and canister base 115 may be formed of a rigid material, such as plastic, fiberglass, carbon fiber, or an aramid impregnated with resin, another composite, metal, or the like. The rigid material may protect internal contents from impacts, abrasion, and the like. In an embodiment, the rigid material may be opaque. In an embodiment, the canister lid 105 and canister base 115 may be made of a material that blocks any light from reaching the inside of the canister 101. Canister lid interior 107 may also be formed of a rigid matter, though it may be of a different rigid material than the canister lid exterior shell 106. For example, canister lid exterior shell 106 may be made of metal, such as steel or aluminum, while canister lid interior 107 may be made of plastic.

Figure 2:
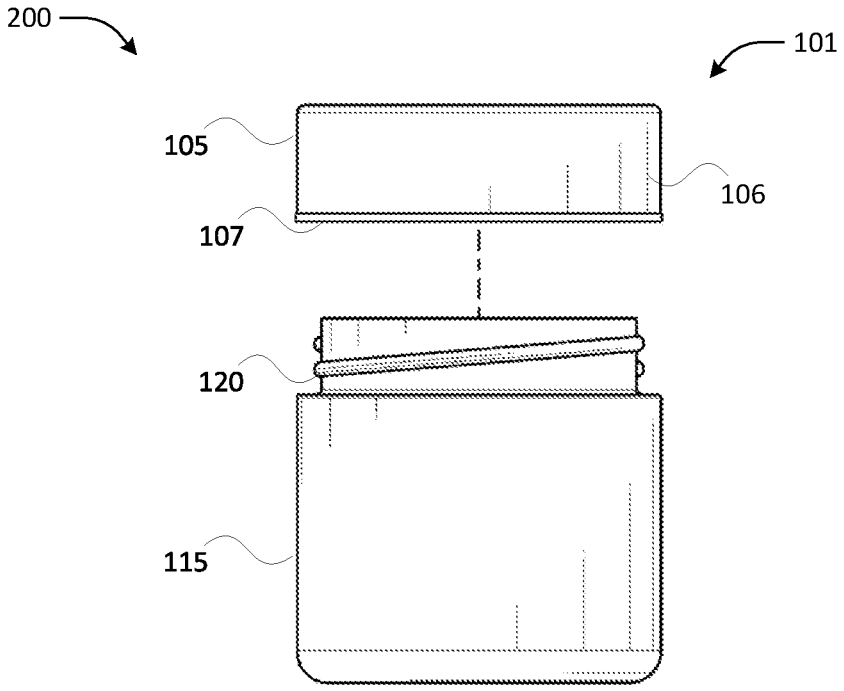
FIG. 2 is a side elevation view of the canister apparatus of FIG. 1, with components partially exploded and incorporated with teachings of the present disclosure, according to some embodiments.

FIG. 2 is a side elevation view 200 of canister apparatus 101 of FIG. 1, with canister lid 105 exploded above canister base 115, according to some embodiments. Canister base 115 may comprise canister base neck 120. Canister base neck 120 may comprise coupling components, such as male or female threads, snap lock, rotation lock, push lock, click lock, or the like, configured to couple to canister lid interior 107. Canister lid interior 107 may comprise coupling components (not shown in FIG. 2) that are configured to couple to the canister base 115.

Figure 3:
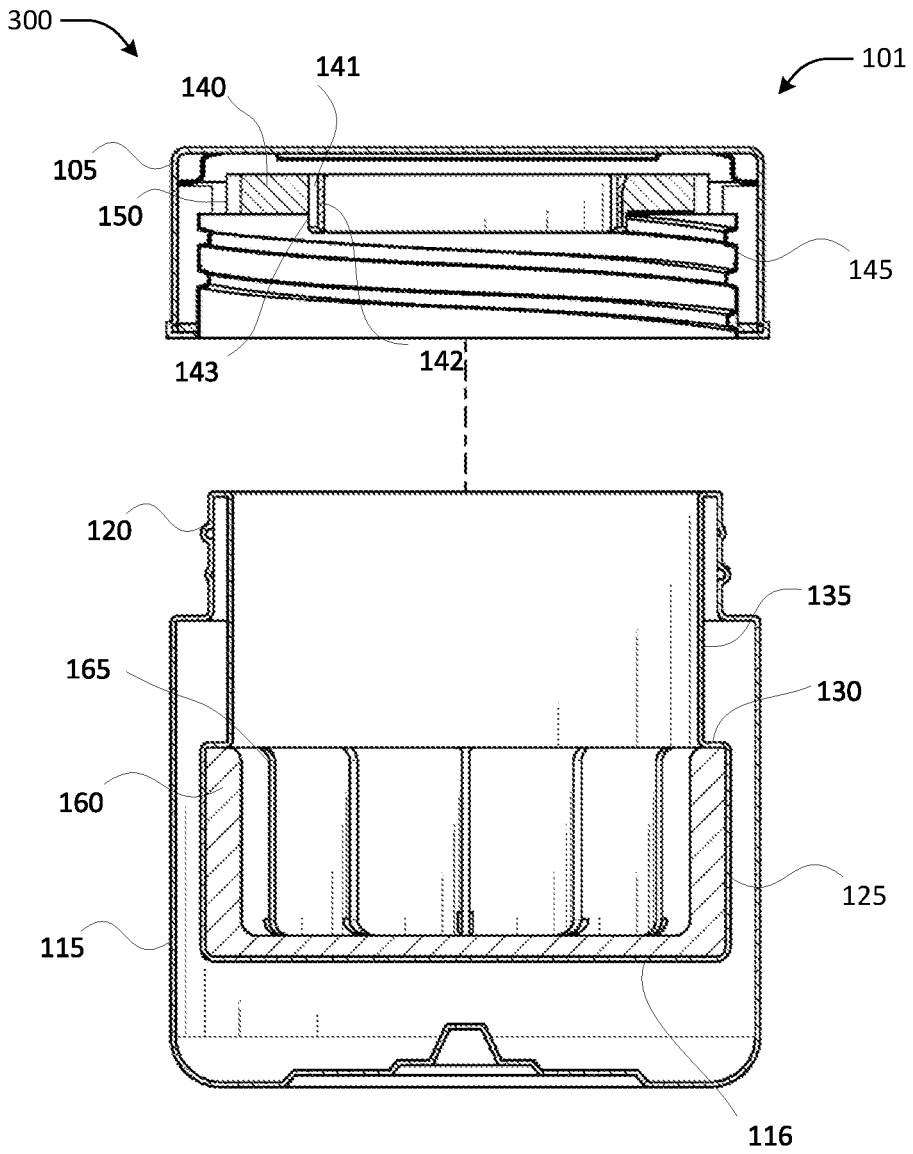
FIG. 3 is a side elevation view of the canister apparatus of FIG. 1, with components partially exploded, with a vertical cross-section showing some internal components, and incorporated with teachings of the present disclosure, according to some embodiments.

FIG. 3 is a side elevation view 300 of canister apparatus 101 of FIG. 1, with canister lid 105 exploded above canister base 115, with a vertical cross-section showing internal components, according to some embodiments. Illustrated internal components of canister lid 105 comprise gasket 140 and boss 141. Gasket 140 may be fabricated from an elastomer, silicone, or deformable material. Boss 141 may be of a circular shape and have a variety of diameters configured to accommodate a range of jars. Boss 141 may comprise boss inner wall 142 and boss outer wall 143. Gasket 140 may be of an O-ring shape and fit between boss outer wall 143 and canister lid inner wall 150. Boss outer wall 143 and canister lid inner wall 150 may stabilize gasket 140 and control how much the gasket 140 can compress, which are important to sealing a jar held by the canister apparatus 101. Canister lid 105 may further comprise one or more desiccant packets fit within boss inner wall 142. The desiccant packets may be attached or secured to the canister lid 105 so that they do not fall inside canister base 115. The desiccant packets may be loaded with any of the available absorbent materials adapted to meet the required conditions that need to be kept inside the canister lid.

Illustrated internal components of the canister lid 105 further comprise canister lid neck 145. Canister lid neck 145 may comprise coupling components, such as, for example, male or female threads, to receive and couple with male threads of canister base neck 120. In other embodiments, the coupling components of the canister lid neck 145 may be a snap lock, rotation lock, push lock, click lock, or the like, configured to couple to the canister base neck 120.

Illustrated internal components of the canister base 115 comprise a first internal cavity 125 and a second internal cavity 135. In an embodiment, the first internal cavity 125 has an inner diameter that is larger than an inner diameter of the second internal cavity 135. For example, the inner diameter of the first internal cavity 125 is 4 mm-8 mm larger than the inner diameter of the second internal cavity 135. In another example embodiment, the diameter difference between the first internal cavity 125 and the second internal 135 may be configured to accommodate a deformable cup 160 fit within the canister base 115. The details of the cup 160 may be found in other places in the present disclosure. Shoulder 130 transitions between the inner diameters of the first internal cavity 125 and the second internal cavity 135. In an embodiment, the first internal cavity 125 may be adjacent to bottom 116 of canister base 115.

Figure 4:
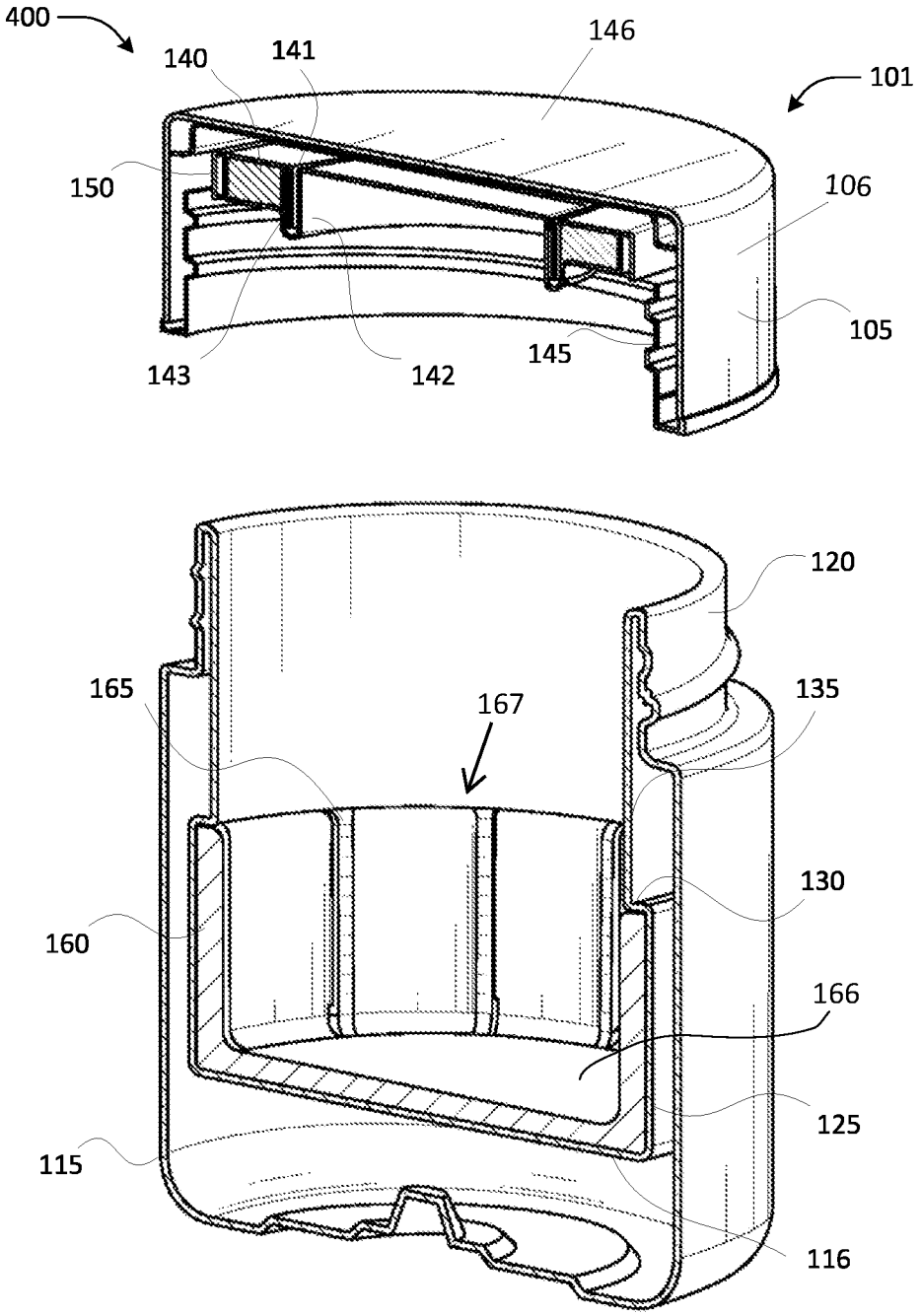
FIG. 4 is a side elevation view of the canister apparatus of FIG. 1, with components partially exploded, with a vertical cross-section showing some additional internal components, incorporated with teachings of the present disclosure, according to some embodiments.

Illustrated internal components of the canister base 115 further comprise cup 160 with a cup opening 167 and a cup bottom 166 (see, for example, FIG. 4). Cup 160 may be fabricated from an elastic material, such as an elastomer (e.g., silicone, rubber) or other deformable material. In an embodiment, cup 160 may fit within the first internal cavity 125, extending up to shoulder 130. In yet another embodiment, cup 160 may extend over shoulder 130 up to a height of the canister base 115. An internal wall of cup 160 may have an internal diameter that is configured to secure a jar upon insertion substantially within the canister base 115. In an embodiment, the internal diameter of the internal wall of cup 160 may be smaller than the inner diameter of the second internal cavity 135. In an embodiment, the internal diameter of the internal wall of cup 160 may be equal to or approximately the same as the inner diameter of the second internal cavity 135. As used herein, "approximately the same" means, for example, the diameter difference between the internal diameter of the cup 160 and the inner diameter of the second internal cavity 135 is within 4 mm-8 mm.

In an embodiment, cup 160 may have an external diameter equal to or larger than the inner diameter of the first internal cavity 125. The cup 160 may be deformable to fit in the first internal cavity 125 even though the external diameter of the cup 160 may be slightly larger than the inner diameter of the first internal cavity 125.

In some embodiments, cup 160 may include one or more ribs 165 extending inward from the cup interior wall of cup 160 and toward a center of canister apparatus 101. In various embodiments, the cup interior wall extends from the cup bottom 166 to the cup opening 167. The ribs 165 may be of a length, width, and thickness that accommodates insertion of a jar substantially within the canister base 115. In various embodiments, the ribs 165 may be elongated ribs that extend lengthwise between the cup bottom 166 and the cup opening 167 along the cup interior wall as illustrated, for example, in FIG. 4. In yet another embodiment, cup 160 does not have ribs extending from the internal wall and is of a size and a material that can provide sufficient tension and grasping force to hold a jar upon insertion substantially within the canister base 115. Cup 160 may securely contain the jar inserted substantially within the canister base 115 even when the canister base 115 is inverted.

Cup 160 may further comprise one or more air evacuation holes so that air between cup 160 and the canister base 115 can be evacuated when cup 160 is inserted within the canister base 115.

FIG. 4 is a side perspective view 400 of canister apparatus 101 of FIG. 1 with canister lid 105 exploded, above canister base 115, with the vertical cross-section showing some internal components of FIG. 3, according to some embodiments. As illustrated, the canister lid 105 includes a canister lid top 146 and the canister lid neck 145. The canister lid neck 145 extends orthogonally (e.g., or vertically downwards) relative to the canister lid top 146. When the canister lid neck 145 is mated to the canister base neck 120 a sealed cavity may be formed to hold, for example, a jar 170. FIG. 4 is provided to clarify views. In the embodiment illustrated by FIG. 4, the bottom 116 may be flat. In another embodiment, the bottom 116 may be curved to accommodate cup 160 to achieve a better seal. Similarly, cup 160 may have a flat or curved bottom. In an embodiment, an area between an interior wall and an exterior wall of the canister base 115 may be filled up with air to provide insulation while reducing weight. In another embodiment, the area may be filled with foam or other insulation material.

Figure 5:
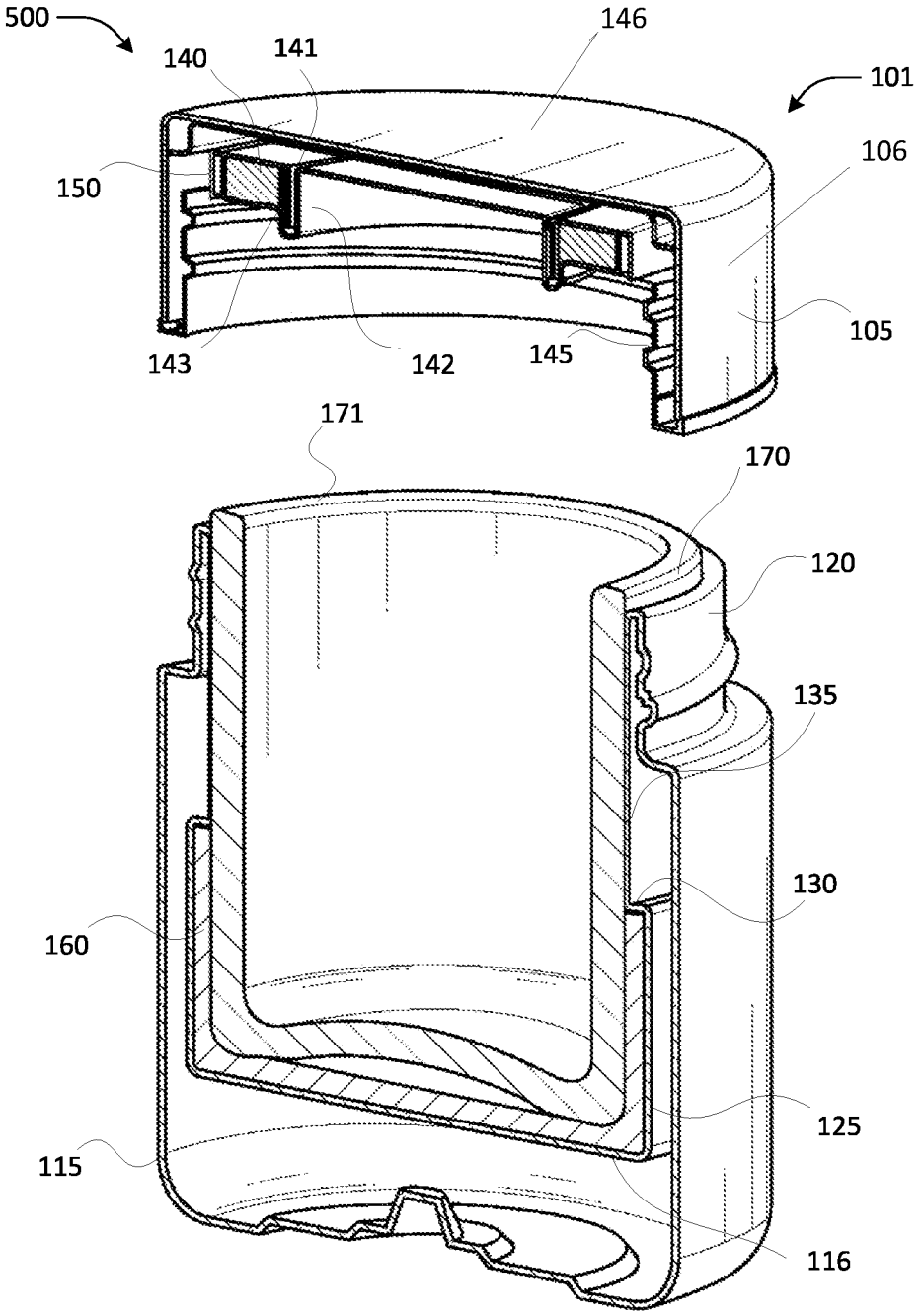
FIG. 5 is a side perspective view of the canister apparatus of FIG. 1, with components partially exploded, with the vertical cross-section showing some internal components of FIG. 4, incorporated with teachings of the present disclosure, according to some embodiments.

FIG. 5 is a side perspective view of canister apparatus 101 of FIG. 1, with canister lid 105 exploded, above canister base 115, with the vertical cross-section showing some internal components of FIG. 4, with an example of a jar 170, according to some embodiments. Jar 170 may fit substantially within canister apparatus 101. For example, jar 170 may have an outer diameter smaller than the inner diameter of the second internal cavity 135. Jar 170 may deform ribs 165 of cup 160, so that jar 170 securely fits within canister base 115. Deformation of ribs 165 of cup 160 may serve to securely hold jar 170 within canister apparatus 101.

In an embodiment, jar 170 may fit substantially within canister base 115. For example, at least 50 percent of jar 170 fits within canister base 115. Jar 17 may comprise rim 171. In an embodiment, the height of the jar 170 may be equal to the height of the canister base 115. In an embodiment, the height of the jar 170 may be larger than the height of the canister base 115, e.g., the rim 171 protruding from the canister base 115 and viewable from outside. In another embodiment, the height of the jar 170 may be smaller than the height of the canister base 115; e.g., the rim 171 is not viewable from outside. Rim 171 may be pressed against gasket 140, such as when canister lid 105 is coupled to canister base 115 containing the jar 170, such as by screwing female threads of canister lid into male threads of canister base neck 120 that defines an opening for the canister base 115.

In an embodiment, a width of rim 171 may not be larger than the distance between boss outer wall 143 and canister lid inner wall 150. Rim 171 may not be larger than the width of a sealing part of gasket 140. In other words, the difference between an outer ring diameter and an inner ring diameter of gasket 140 may be larger than two times the width of rim 171, so that rim 171 can be securely pressed against gasket 140 and form an airtight seal of the internal volume of the jar 170.

Sharp torsional acceleration or linear acceleration of canister apparatus 101 may cause a top of a jar, such as jar 170, to pivot within canister apparatus 101, relative to a base of the jar 170, wherein the top of the jar 170 may then violently contact second internal cavity 135 of canister base 115, potentially resulting in breakage or damage. To protect against this, as well as to seal the jar and minimize evaporation and loss of volatiles perishables in the jar, gasket 140, boss 141, and coupling components may stabilize the top of a range of jars when the canister lid and canister base are secured together.

Gasket 140 and boss 141 may be sized to accommodate a range of jars. By securing canister base 115 and canister lid 105 together with the coupling components, gasket 140 and boss 141 may form an airtight seal with jar 170; and they may stabilize jar 170, so that jar 170 does not contact and break against a wall of the canister base 115, such as a wall of the second internal cavity 135. The ribs 165 of cup 160 may secure and protect jar 170 within the first internal cavity 125. The ribs 165 may be less than one-half the height of the canister base 115, which reduces the usage of materials and saves money. In this way, canister apparatus 101 may contain a range of jars, protect the range of jars from external perturbation, seal the range of jars against leaks, and protect perishables therein from dehydration or loss of volatiles. Canister apparatus 101 may securely contain the jars substantially within the canister base 115 even when the canister base 115 is inverted.

Figure 6:
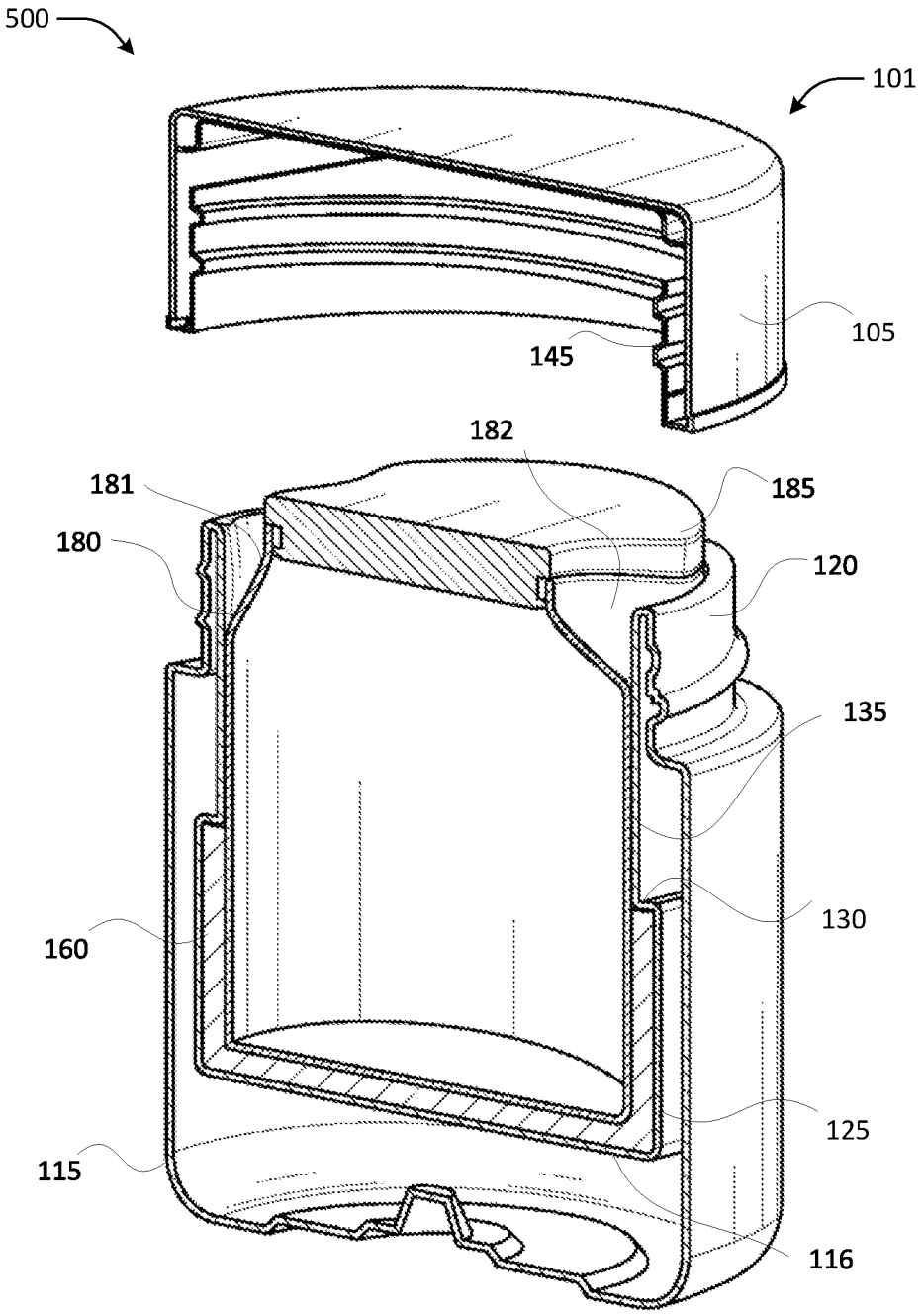
FIG. 6 is a side perspective view of the canister apparatus of FIG. 1, with components partially exploded, with the vertical cross-section showing some internal components of FIG. 4, with an example of a first jar, incorporated with teachings of the present disclosure, according to some embodiments.

FIG. 6 is a side perspective view of canister apparatus 101 of FIG. 1, with canister lid 115 exploded, above canister base 115, with the vertical cross-section showing some internal components of FIG. 4, with an example of a jar 180. Jar 180 may have different dimensions than jar 170. In an embodiment, jar 180 may comprise a cover 185 coupled to an opening of jar 180. The cover 185 provides an airtight seal between the cover 185 and the jar 180. In an embodiment, cover 185 and an opening of jar 180 may include coupling components configured to provide the airtight seal between cover 185 and jar 180. The coupling components may be, for example, threads, press-seal components, and twist-seal components. Cover 185 may be rotationally coupled to jar 180.

In an embodiment, jar 180 may further comprise one or more gripping features. In the example embodiment illustrated by FIG. 6, the gripping features may be grooves 181 and 182 on surfaces of the jar 180 and configured to engage one or more fingers of a grasping hand. Grooves 181 and 182 may be on opposite sides of jar 180. In another embodiment, jar 180 may have one groove.

Figure 7:
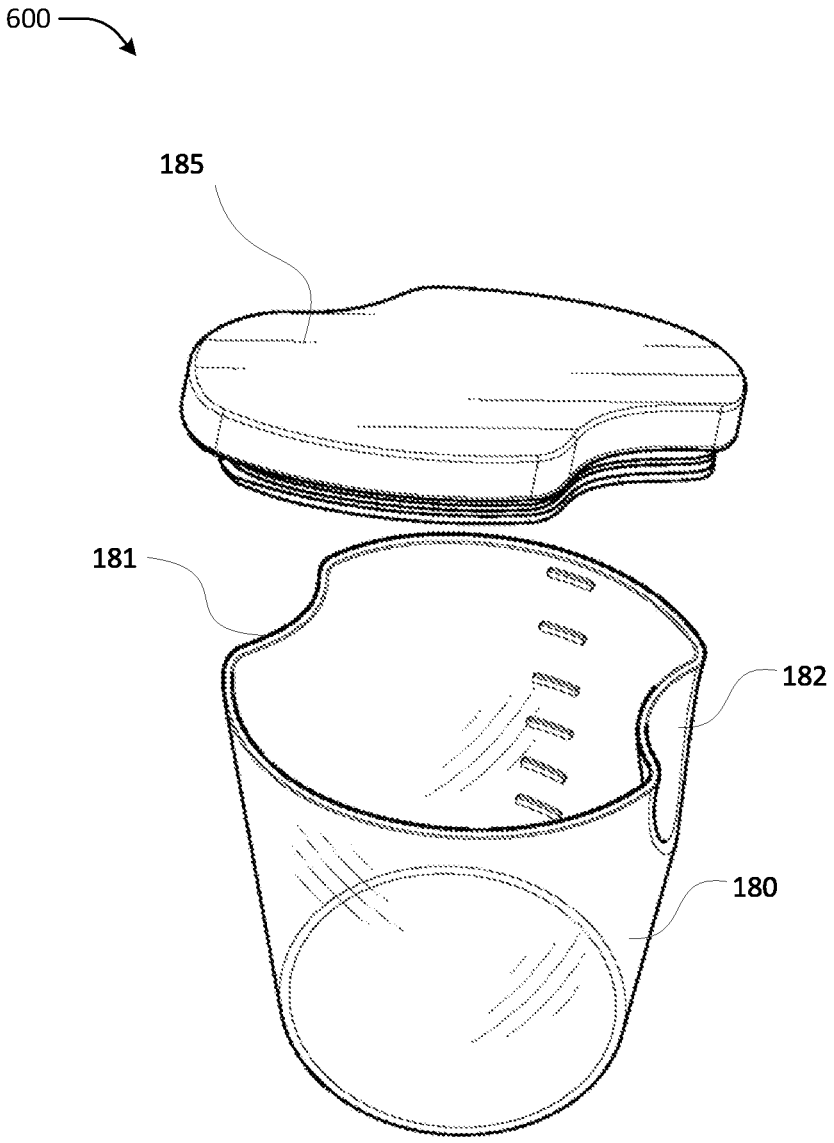
FIG. 7 is a side perspective view of the jar illustrated in FIG. 6, with components exploded, according to some embodiments.

FIG. 7 is a side perspective view 600 of an example jar 180 illustrated in FIG. 6, with components exploded, according to some embodiments. FIG. 7 illustrates an embodiment that jar 180 may comprise gripping features, such as grooves 181 and 182 on opposite sides. In yet another embodiment, jar 180 may comprise only one groove to provide easy loading and unloading jar 180.

The canister apparatus 101 may be of different sizes and configured to hold a variety of jars. In an example embodiment, the capacity of canister base 115 may have a capacity between 50-150 ml. In an example embodiment, the canister apparatus 101 may have a height between 50-120 mm and a width between 50-100 mm. In an example embodiment, canister apparatus 101 may accommodate to hold a jar of 43 mm in height and 44 mm in width.

In some embodiments, the canister apparatus 101 may accommodate a jar of cylindrical shape. In some other embodiments, the canister apparatus 101 may accommodate a jar of tapered shape, e.g., a jar having a smaller opening than a jar body. In some embodiments, the canister apparatus 101 may accommodate a common jar such as a mason jar.

In some embodiments, the canister apparatus 101 may accommodate a jar having measurement indicators. The measurement indicators may be printed, bossed, or embossed on a surface of the jar. In some embodiments, the canister apparatus 101 may accommodate a jar having a pouring spout.

The subject matter of the present invention is described with specificity herein to meet statutory requirements. However, the description itself is not intended to limit the scope of this disclosure. Rather, the inventors have contemplated that the disclosed or claimed subject matter might also be embodied in other ways, including different steps or combinations of steps similar to the ones described in this document, in conjunction with other present or future technologies.

As used herein, "elastomer" refers to a polymeric material that can be stretched or deformed and returned to its original shape without substantial permanent deformation. Elastomers commonly undergo substantially elastic deformations. Example elastomers include those comprising polymers, copolymers, composite materials, or mixtures of polymers and copolymers. Elastomers include, but are not limited to, thermoplastic elastomers, styrenic materials, olefinic materials, polyolefin, polyurethane thermoplastic elastomers, polyamides, synthetic rubbers, PDMS, polybutadiene, polyisobutylene, poly(styrene-butadiene-styrene), polyurethanes, polychloroprene and silicones. In some embodiments, an elastomeric stamp comprises an elastomer. Exemplary elastomers include, but are not limited to silicon containing polymers such as polysiloxanes including poly (dimethyl siloxane) (i.e. PDMS and h-PDMS), poly(methyl siloxane), partially alkylated poly(methyl siloxane), poly (alkyl methyl siloxane) and poly(phenyl methyl siloxane), silicon modified elastomers, thermoplastic elastomers, styrenic materials, olefinic materials, polyolefin, polyurethane thermoplastic elastomers, polyamides, synthetic rubbers, polyisobutylene, poly(styrene-butadiene-styrene), polyurethanes, polychloroprene and silicones.

As used herein, "container," "canister," and "jar" may be used interchangeably. They mean a wide-mouthed container or vessel, sometimes having a lid, which may be made of glass, pottery, plastic, metal, or the like. Jars occur in many sizes.

As used herein, "secure," "secured," or "securable" refers to two or more structures or components that are connected or attached.

As used herein, "attach," "attached," or "attachable" refers to two or more structures or components which are attached through the use of tools or chemical or physical bonding, but wherein the structures or components may not generally be released or re-attached in a repeatable manner.

As used herein, "substantially" and "substantial" refer to a considerable degree or extent, for example, at least larger than 50 percent. The given values include values in height, length, area, temperature, angle dimensions, among others.

The invention claimed is:

1. A canister apparatus, comprising:

a canister base including a first internal cavity and a second internal cavity, wherein the first internal cavity comprises a first inner diameter and the second internal cavity comprises a second inner diameter, and wherein the first inner diameter is larger than the second inner diameter, wherein the canister base further includes a canister base neck that defines an opening for the canister base;

a canister lid including a canister lid top, a canister lid neck that extends orthogonally downwards relative to the canister lid top, a gasket, and a boss, wherein when the canister lid neck is mated to the canister base neck a sealed cavity is formed to hold a jar, wherein the gasket and the boss are located on an interior side of the canister lid top within an interior diameter of the canister lid neck and sized to accommodate an airtight seal of an internal volume of the jar when the canister lid neck is mated to the canister base neck and the jar is in the sealed cavity; and a cup, wherein the cup fits within the first internal cavity, the cup comprising a cup interior wall including a third inner diameter, wherein the third inner diameter of the cup interior wall is smaller or equal to the second inner diameter of the second internal cavity, and wherein the cup is configured to deform and secure the jar upon insertion substantially within the canister base.

2. A canister apparatus, comprising:

a canister base including a first internal cavity and a second internal cavity, wherein the first internal cavity comprises a first inner diameter and the second internal cavity comprises a second inner diameter, and wherein the first inner diameter is larger than the second inner diameter;

a canister lid including a gasket and a boss, wherein the gasket and the boss are sized to accommodate an airtight seal of a jar upon insertion substantially within the canister base; and a cup, wherein the cup fits within the first internal cavity, the cup comprising:

a cup bottom and a cup opening opposite of the cup bottom;

a cup interior wall including a third inner diameter, wherein the third inner diameter of the cup interior wall is smaller or equal to the second inner diameter of the second internal cavity, the cup interior wall extending from the cup bottom to the cup opening; and a plurality of ribs protruding inward, toward a center of the canister apparatus, from the cup interior wall, the plurality of ribs further being a plurality of elongated ribs that extend lengthwise between the cup bottom and the cup opening along the cup interior wall.

3. The apparatus of claim 2, wherein the cup has a height equal to a height of the first internal cavity.

4. The apparatus of claim 2, wherein the cup comprises an elastomeric material.

5. The apparatus of claim 2, further comprises a jar of a diameter and a depth to fit substantially within the canister base and mate with the cup.

6. The apparatus of claim 5, further comprises a spout coupled to the jar.

7. The apparatus of claim 5, further comprises one or more gripping features coupled to the jar.

8. The apparatus of claim 2, further comprises a child-resistant closure coupled to the canister lid.

9. The apparatus of claim 2, further comprises an insulation layer between an exterior wall and an interior wall of the canister base.

10. A canister apparatus, comprising:

an enclosure including a first internal cavity and a second internal cavity, wherein the first internal cavity comprises a first inner diameter and the second internal cavity comprises a second inner diameter, and wherein the first inner diameter is larger than the second inner diameter; and a lid including one or more coupling components configured to secure the lid with the enclosure; and a cup, wherein the cup fits within the first internal cavity, the cup comprising:

a cup bottom and a cup opening opposite of the cup bottom;

a cup interior wall including a third inner diameter, wherein the third inner diameter of the cup interior wall is smaller or equal the second inner diameter of the second internal cavity, the cup interior wall extending from the cup bottom to the cup opening; and a plurality of ribs protruding inward, toward a center of the canister apparatus, from the cup interior wall, the plurality of ribs further being a plurality of elongated ribs that extend lengthwise between the cup bottom and the cup opening along the cup interior wall.

11. The apparatus of claim 10, wherein the cup has a height equal to a height of the first internal cavity.

12. The apparatus of claim 10, wherein the cup comprises an elastomeric material.

13. The apparatus of claim 10, further comprises a jar of a diameter and a depth to fit substantially within the enclosure and mate with the cup.

14. The apparatus of claim 13, further comprises a cover coupled to an opening of the jar to provide an airtight seal between the cover and the jar.

15. The apparatus of claim 13, further comprises one or more gripping features coupled to the jar.

16. The apparatus of claim 15, wherein the gripping features include a first grip surface and a second grip surface opposed, wherein the first and second grip surfaces are configured to engage one or more fingers of a grasping hand.

17. The apparatus of claim 13, further comprises a spout coupled to the jar.

18. The apparatus of claim 13, further comprises measurement indicators coupled to the jar.

19. The apparatus of claim 10, further comprises a child-resistant closure coupled to the lid.

20. The apparatus of claim 10, further comprises an insulation layer between an exterior wall and an interior wall of the enclosure.

* * * * *